US006538204B2

(12) United States Patent
Connor

(10) Patent No.: US 6,538,204 B2
(45) Date of Patent: Mar. 25, 2003

(54) ELECTRICAL COMPRESSION CONNECTOR

(75) Inventor: Brian W. Connor, Amherst, NH (US)

(73) Assignee: FCI USA, Inc., Etters, PA (US)

( * ) Notice: Subject to any disclaimer, the term of this patent is extended or adjusted under 35 U.S.C. 154(b) by 0 days.

(21) Appl. No.: 09/902,211

(22) Filed: Jul. 10, 2001

(65) Prior Publication Data

US 2003/0010524 A1 Jan. 16, 2003

(51) Int. Cl.[7] ..... H01R 4/00
(52) U.S. Cl. ..... 174/84 R; 174/84 C
(58) Field of Search ..... 174/84 R, 84 C, 174/90, 92, 94 R; 439/877, 878; 403/275, 391

(56) References Cited

U.S. PATENT DOCUMENTS

| | | | | | |
|---|---|---|---|---|---|
| 2,938,069 | A | * | 5/1960 | Toedtman et al. | 174/71 R |
| 2,956,108 | A | * | 10/1960 | Brenner | 174/71 R |
| 3,322,888 | A | * | 5/1967 | Zemels | 174/71 R |
| 3,354,517 | A | * | 11/1967 | Levinski | 174/71 R |
| 3,781,459 | A | * | 12/1973 | Peek | 174/71 R |
| 4,350,843 | A | * | 9/1982 | Campbell et al. | 174/84 C |
| 5,036,164 | A | * | 7/1991 | Schrader et al. | 174/7 |
| 5,103,068 | A | * | 4/1992 | Schrader et al. | 174/71 R |
| 5,162,615 | A | * | 11/1992 | Schrader et al. | 174/71 R |
| 5,200,576 | A | * | 4/1993 | Schrader et al. | 174/71 R |
| 5,396,033 | A | * | 3/1995 | Piriz et al. | 174/71 R |
| 5,635,676 | A | * | 6/1997 | Piriz | 174/84 C |
| 5,898,131 | A | | 4/1999 | Chadbourne et al. | 174/84 C |
| 6,261,137 | B1 | * | 7/2001 | Wilcox | 174/84 C |

OTHER PUBLICATIONS

YH292C Data Sheet Burndy Electrical (FCI USA Inc.), Dec. 28, 1990, Rev #9.*

* cited by examiner

*Primary Examiner*—Dean A. Reichard, II
*Assistant Examiner*—William H. Mayo, III
(74) *Attorney, Agent, or Firm*—Harrington & Smith, LLP

(57) ABSTRACT

An extruded one-piece electrical compression connector having a general U-shaped top section forming a first conductor receiving channel and a bottom section having two second conductor receiving channels extending into respective opposite lateral sides of the bottom section. Portions of the bottom section extend laterally outward at a lateral side aperture into each of the two second conductor receiving channels. The portions deform to close the lateral side apertures at a start of compression of the connector.

19 Claims, 5 Drawing Sheets

ELECTRICAL COMPRESSION CONNECTOR

BACKGROUND OF THE INVENTION

1. Field of the Invention

The present invention relates to electrical connectors and, more particularly, to an electrical compression connector.

2. Prior Art

U.S. Pat. No. 5,898,131 discloses a twisted H-shaped electrical connector. A hydraulic compression tool can be used to compress the connector for connecting two conductors to each other at the same time. FCI USA Inc. sells electrical compression connectors under the part designation YH298C which are specifically designed for the telecommunications industry for making parallel and tap connections to copper Class I and Class K stranded conductors.

Class K conductors are more flexible than Class I conductors. This increased flexibility is provided by a substantially larger number of individual strands in the conductor. For example, an 8 AWG Class I copper stranded conductor has 41 strands and an 8 AWG Class K copper stranded conductor has 168 strands. The individual strands of a Class K conductor have a smaller diameter than the individual strands in a Class I conductor (0.01 inch versus 0.201 inch). However, a Class K conductor has a larger outer diameter than a Class I conductor of the same electrical size (i.e., an 8 AWG Class K conductor has a 0.157 inch nominal diameter, and an 8 AWG Class I conductor has a 0.156 inch nominal diameter).

For the YH298C connector, the tap conductor receiving channels can accept and be properly crimped onto a Class I conductor between 8–14 AWG or a Class K conductor between 10–14 AWG. The YH298C connector has problems being properly crimped onto an 8 AWG Class K conductor at its tap conductor receiving channels. The tap conductor receiving channels are too small to properly retain all the strands of the 8 AWG Class K conductor. Although an 8 AWG Class K conductor can be placed inside the tap conductor receiving channels of the conventional YH298C compression connector, during compression strands of the Class K conductor are pushed out of the lateral side aperture of the tap conductor receiving channel before the aperture is closed. This creates a problem electrically due to the small percentage of strands actually contained in the compressed conductor tap receiving channel. These non-contained stands can also contact and thereby cause problems with nearby electrical or electronic components. In addition, these strands can break off of the conductor and cause additional problems with nearby electrical or electronic components.

There is a desire to provide an electrical compression connector with tap conductor receiving channels which can be used with Class I and Class K conductors having the same electrical wire size. There is also a desire to provide an electrical compression connector adapted to be connected to a Class I conductor or a Class K conductor of the same size and can be compressed onto the Class K conductor without strands of the conductor being pushed out of a lateral side aperture into the tap conductor receiving area before the aperture is closed.

SUMMARY OF THE INVENTION

In accordance with one embodiment of the present invention, an electrical compression connector is provided comprising a first section having a first conductor receiving channel extending into a first top side of the connector; and a second section integrally formed with the first section having a second conductor receiving channel extending into a second lateral side of the connector. The second section comprises a bottom portion at the second conductor receiving channel curving upward and extending outward laterally past a top portion of the second section at the second conductor receiving channel. The first and second sections are adapted to be compressed in a compression tool onto conductors at substantially a same time with an aperture into the second conductor receiving channel at the second lateral side being closed by the bottom portion of the second section before substantial compression of the first section onto its respective conductor.

In accordance with another embodiment of the present invention, an electrical compression connector is provided comprising a first section having a first conductor receiving channel extending into a top side of the connector; and an integral second section having two second conductor receiving channels extending into two opposite lateral sides of the connector. The two second conductor receiving channels are each sized and shaped to receive and be operably compressed onto Class I or Class K stranded conductors between 14 AWG and 8 AWG in size. Opposite bottom portions of the second section at the two conductor receiving channels extend upward and extend laterally outward past lateral sides of top portions of the second section at the second conductor receiving channels.

In accordance with another embodiment of the present invention, an extruded one-piece electrical compression connector is provided having a general U-shaped top section forming a first conductor receiving channel and a bottom section having two second conductor receiving channels extending into respective opposite lateral sides of the bottom section. Portions of the bottom section extend laterally outward at a lateral side aperture into each of the two second conductor receiving channels. The portions deform to close the lateral side apertures at a start of compression of the connector.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
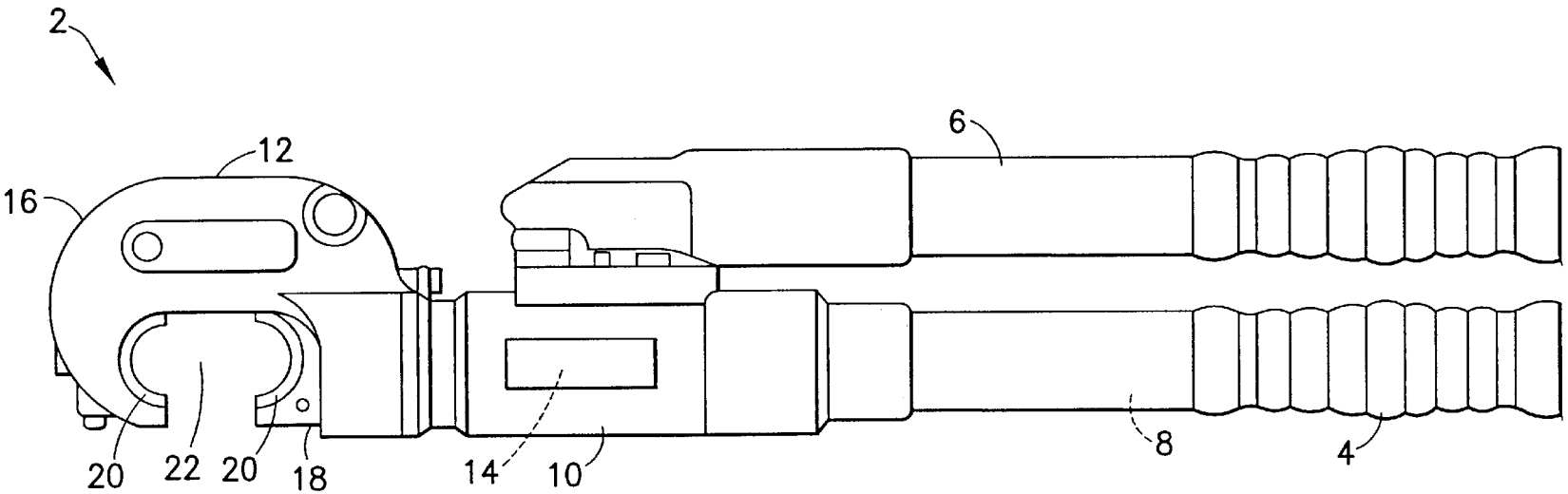
FIG. 1 PRIOR ART
FIG. 1 is an elevational side view of a conventional hydraulic hand operated connector compression tool.

Referring to FIG. 1, there shown an elevational side view of a conventional hydraulic tool 2 used to compress electrical compression connectors onto electrical conductors. One such tool is sold by FCI USA Inc. under the part designation Y750. However, the electrical connector of the present invention could be compressed onto electrical conductors by any suitable type of compression tool. For example, another such tool is sold by FCI USA Inc. under the part designation Y46.

The tool 2 shown in FIG. 1 generally comprises a first handle 4 having a fluid reservoir 8 therein, a second handle 6, a body 10 and a compression head 12. A hydraulic pump 14 is located inside the body 10. The compression head 12 generally comprises a frame 16 and a movable ram 18. The ram 18 is moved forward on the frame 16 by hydraulic pressure from hydraulic fluid delivered from the pump 14. The frame 16 and the ram 18 are each adapted to removably receive a crimping die 20. A connector receiving space 22 is formed between the two crimping dies 20. When the ram is advanced to move the two dies 20 towards each other, a connector located between the two dies is compressed or crimped.

Figure 2:
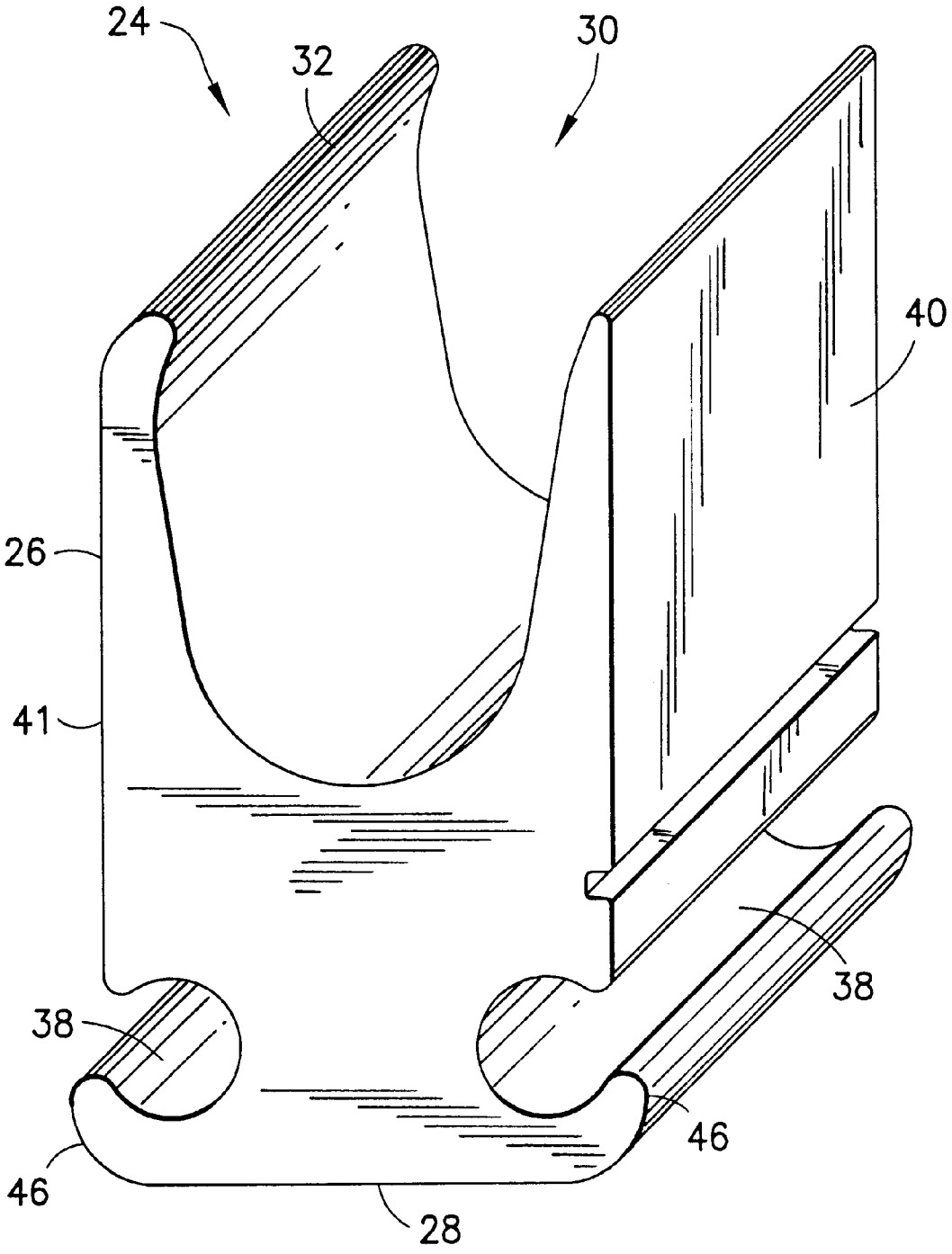
FIG. 2 is a perspective view of an electrical compression connector incorporating features of the present invention.
Figure 3:
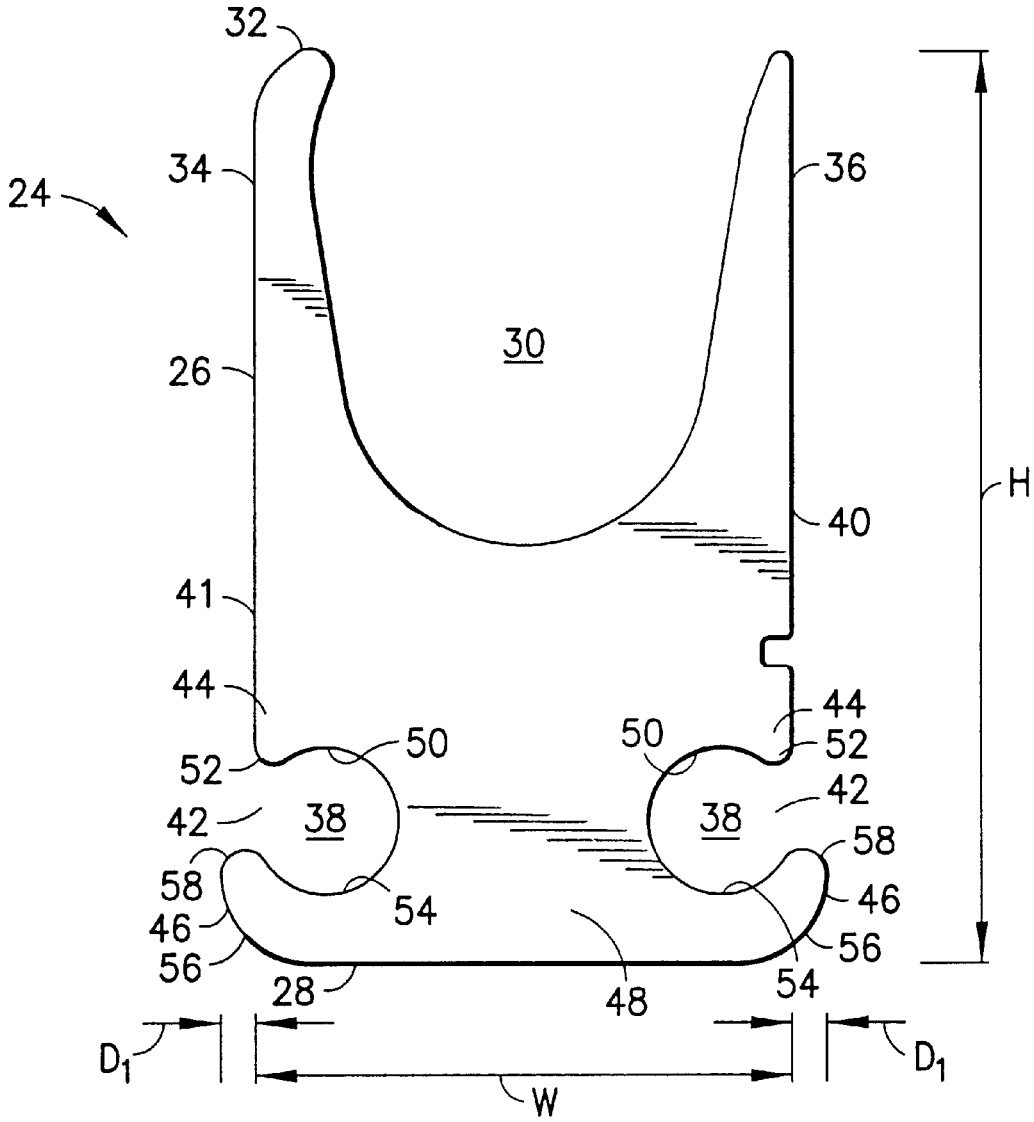
FIG. 3 is a front elevational view of the connector shown in FIG. 2.

Referring to FIGS. 2 and 3, there are shown a perspective view and a front elevational view of an electrical compression connector 24 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

The connector 24 comprises a one-piece member. The one-piece member is preferably comprised of metal, such as copper. However, the one-piece member could be comprised of multiple components and/or could be comprised of any suitable materials, such as aluminum. The one-piece member is preferably an extruded member. However, any suitable type of method for manufacturing the one-piece member could be provided.

The connector 24 generally comprises a first section 26 and a second section 28. In this embodiment, the first section 26 is a top section of the connector and the second section 28 is a bottom section of the connector. The two sections 26,28 are preferably integrally formed with each other during the extrusion process. Because the connector 24 is preferably manufactured by an extrusion process, the connector has a substantially uniform cross-section along its length. However, in alternate embodiments, the connector 24 could have sections along its length which do not have a uniform cross-section.

The top section 26 has a first conductor receiving channel 30 extending into a first top side 32 of the connector. The top section 26 has a general U-shaped profile. A first leg 34 has a curved top end. A second leg 36 has a relatively tapered or pointed top end. However, in alternate embodiments, the top section 26 and the legs 34, 36 could have any suitable type of shape.

The bottom section 28 has two second conductor receiving channels 38. The two second channels 38 form first and second tap conductor receiving channels. The first channel 30 forms a main run conductor receiving channel. The three conductor receiving channels 30, 38 and 38 extend generally parallel to each other. The two tap channels 38 are substantially mirror images of each other. However, in alternate embodiments, the two tap channels could have different shapes. In addition, more or less than two tap conductor channels could be provided.

The two tap conductor channels 38 extend into respective opposite lateral sides 40,41 of the connector. Each tap channel 38 has a general circular shape with an aperture 42 at its respective lateral side 40,41. However, in alternate embodiments, any suitable shape, other than a circular shape, could be provided. At each tap channel 38, the bottom section 28 comprises a top portion 44 and a bottom portion 46. A middle section 48 is located between the two tap channels 38.

Each top portion 44 has a curved lower surface 50 which forms a protrusion 52 at a junction of the surface 50 with the respective lateral side 40,41. The protrusions 52 projected in a general downward direction towards the bottom portions 46. Each bottom portion 46 has a curved upper surface 54, a curved outer surface 56 and an outer end with a curved tip 58. The middle section 48 has a substantially flat bottom surface. The bottom of the second section, thus, has a substantially flat bottom surface with an upward curved section at each of the bottom portions 46. The two bottom portions 46 form general curved finger shapes defined by the curved surfaces 54,56 and 58. The tips 58 extend upward and also extend laterally outward. The tips 58 extend laterally outward past the lateral sides 40,41 as indicated by distances $D_1$.

In a preferred embodiment, the connector 24 has a height H which is about 1.525 inches, and a width W between the lateral sides 40,41 which is about 0.9 inch. However, in alternate embodiments, the connector could have any suitable height and width. These dimensions (H and W) and the shape of the top section 26 are substantially the same as an existing conventional electrical compression connector sold by FCI USA Inc. under the part designation YH298C. However, the YH298C electrical compression connector does not comprise outwardly projecting tips at the bottom sides of its second conductor receiving channels.

In a preferred embodiment, the tap channels 38 have a diameter of about 0.25 inch. However, any suitable size could be provided. Both tap channels 38 can receive a 8–14 AWG Class K conductor or a 8–14 AWG Class I conductor with all the strands of the conductors (Class I or Class K) contained in the tap channels. In the YH298C connector, tap channels could receive and be fully crimped to a Class K conductor between 10–14 AWG. The connector 24 can receive a Class K conductor between 8–14 AWG in both its tap channels 38.

The connector 24 differs from the YH298C compression connector in two main respects. First, the second conductor receiving areas 38 have a larger diameter than in the conventional connector. In a preferred embodiment the diameter of the second conductor receiving channels 38 is about 0.25 inch. Second, the bottom section 28 has the two bottom curved finger shaped portions 46 which extend upwardly and extend laterally outwardly past the lateral sides of the top portions 44. In the preferred embodiment, the distances $D_1$ are each preferably about 0.05 inch. However, in alternate embodiments, any suitable distance could be provided for $D_1$. The combination of these two features provide a new and improved electrical compression connector which has numerous advantages.

The conventional YH298C electrical compression connector is adapted to connect to Class I copper stranded conductor with a main run wire size (in its main conductor receiving area) between 250 kcmil–2 AWG, and a tap wire size 8–14 AWG. The connector 24 is sized and shaped to connect to the same range of Class I copper conductors as the conventional YH298C electrical compression connector. However, the connector 24 is also sized and shaped to connect to the same range electrical sizes of the larger outer diameter Class K stranded conductors.

When the conventional YH298C electrical compression connector was attempted to be connected to an 8 AWG Class K stranded conductor in its tap channels, during crimping strands of the Class K conductor are pushed out of the tap channels and are not completely captured in the tap channels. This caused problems as noted above. The present invention overcomes these problems. The present invention allows all the strands of the 8 AWG Class K conductor to be retained in the tap channels 38 during compression of the connector 24. This feature is provided by the combination of the increased diameter of the tap channels 38 and the extended shape of the bottom portions 46.

Figure 4:
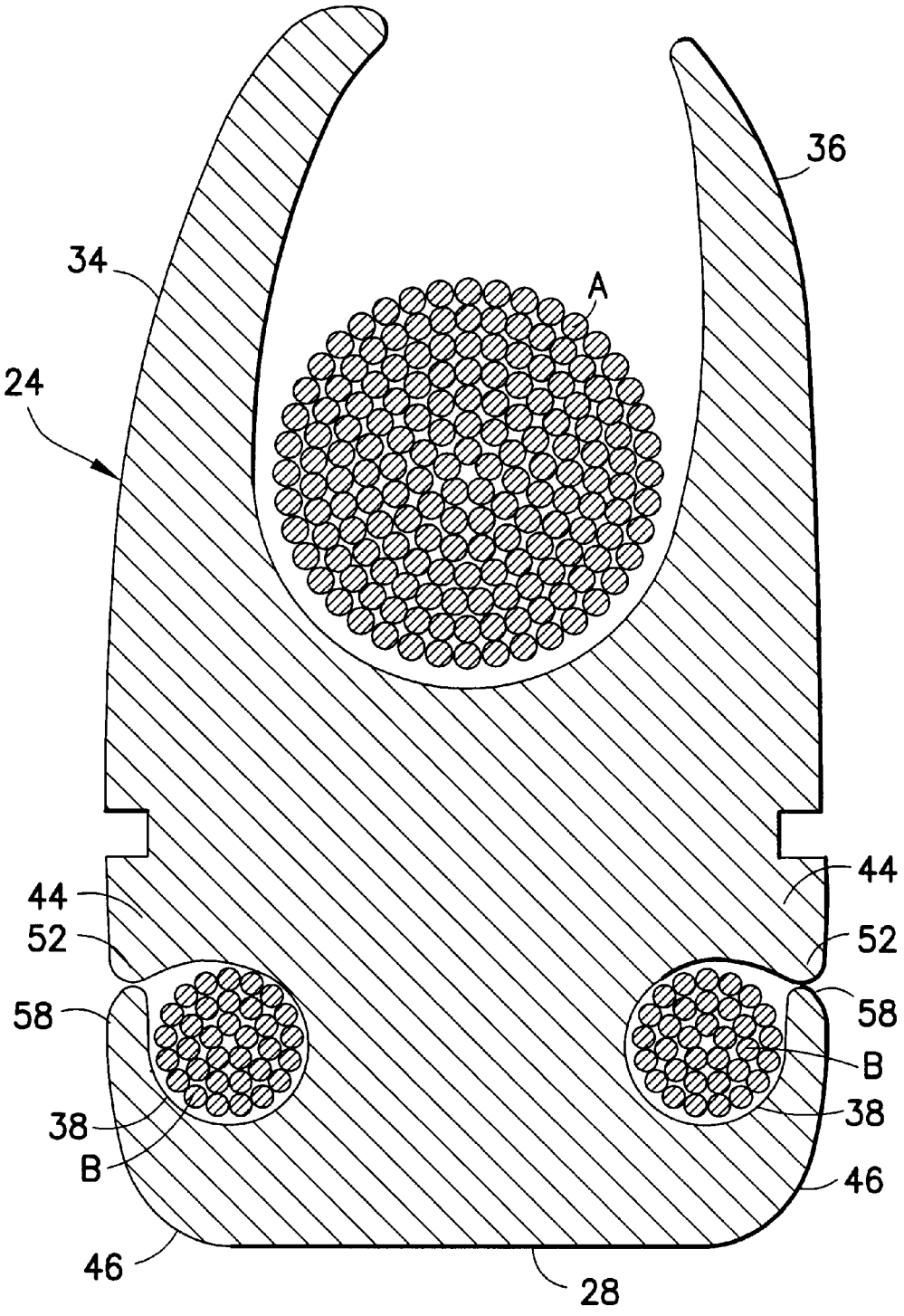
FIG. 4 is a front elevational view of the connector shown in FIG. 3 and three conductors with the connector partially crimped onto the conductors.

Referring also to FIG. 4, the connector 24 is shown at a partially crimped condition onto a main conductor A and two tap conductors B. With the present invention, during the compression or crimping process, the bottom portions 46 are deformed upward and inward to contact the projections 52 of the top portions 44. This closes the lateral side apertures 42 into the tap channels 38. The deformation of the bottom portions 46, to close the lateral side apertures 42, is completed before substantial compression of the main conductor A in the top section 26 occurs. In other words, the closing of the lateral side apertures 42 occurs at an early stage during the connector compression process. This early stage closing of the lateral side apertures 42 prevents strands of the Class K conductor from exiting the apertures 42 during the start of crimping. This is because the apertures 42 are closed before the Class K tap conductors B in the tap channels 38 are exposed to substantial compression. Therefore, compressive forces acting upon the tap conductors B before the apertures 42 close are insufficient to force strands of the tap conductors B out of the apertures 42. With the apertures 42 closed, the connector 24 can continue to be compressed to fully crimp the connector on the conductors A, B and B. Thus, the connector 24 can be used to connect to both Class I and Class K stranded conductors.

Figure 5:
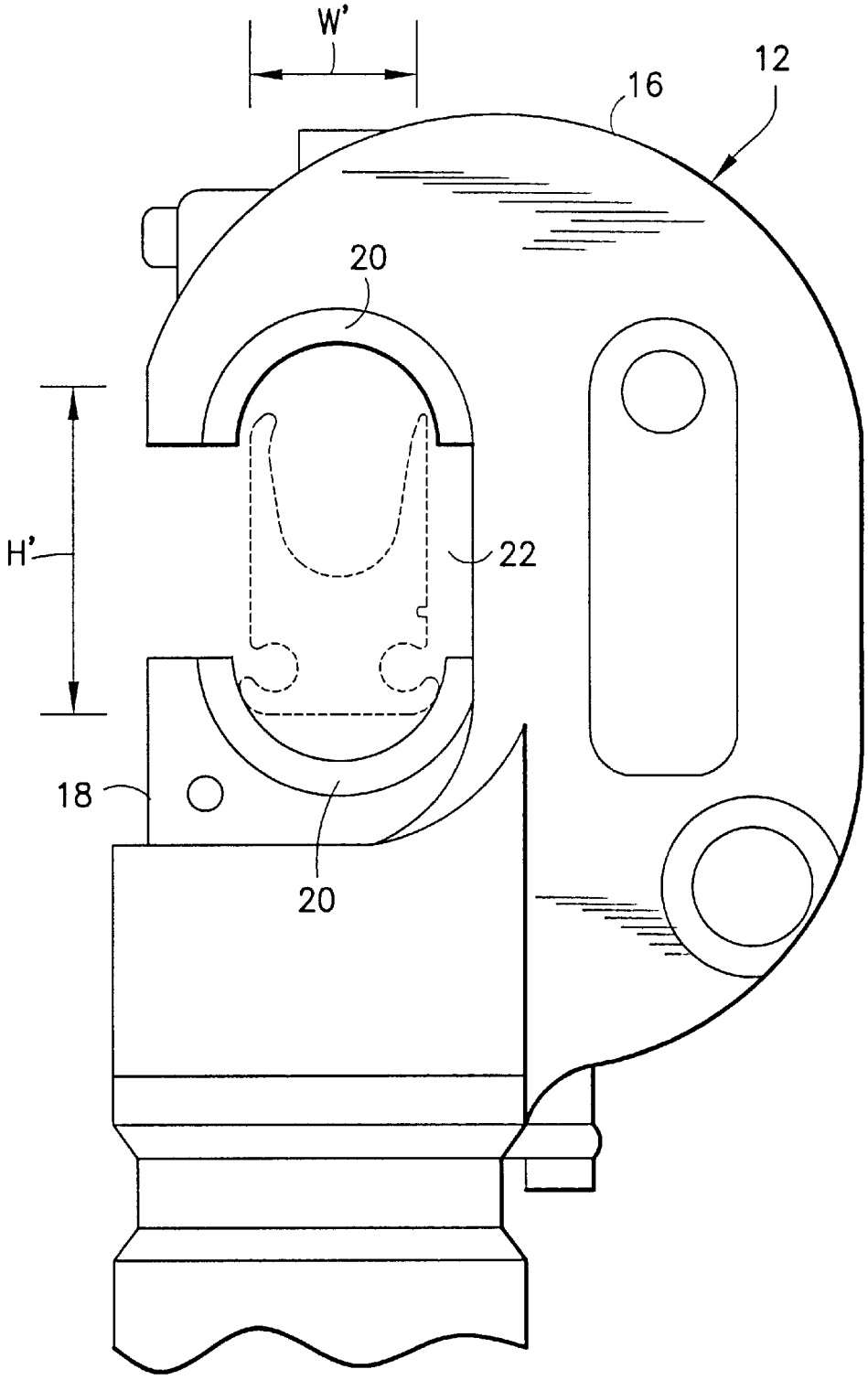
FIG. 5 is an enlarged elevational view of the crimping head of the tool shown in FIG. 1 with the connector shown in dotted lines.

Referring also to FIG. 5, another feature of the present invention will be described. As noted above, the dimensions H and D are preferably substantially the same as the conventional YH298C electrical compression connector. The YH298C connector is compressed or crimped by use of specific types of dies 20 in the tool 2, such as U dies or P dies sold by FCI USA Inc. (more specifically, U654 dies for the Y750 tool and P654 dies for the Y46 tool). There is a desire to allow Class K conductors to be connected by a compression connector, similar to the YH298C connector, which can use the same tool (such as a Y46 or Y750 tool) and the same dies (such as U654 dies or P654 dies) as have been used in the past to crimp the YH298C connector. However, the connector receiving area 22 between the dies 20 has a limited space. This presents a height H' and width W' limitation for any type of new connector if the same tool and dies are desired to be used. Thus, the overall size of the new connector could not merely be increased. If the new connector was too big, it could not fit within the connector receiving area 22. In addition, the body of the connector must comprise sufficient material and sufficient dimensions to prevent failure of the connector during crimping or compression and, have adequate electrical properties.

The connector 24 has been specifically designed to be usable with the same tool and dies as were used in the past to crimp the YH298C connector. Therefore, users do not need to buy a new tool or new dies. The same tool and dies used to crimped the YH298C connector can be used to crimp the connector 24 onto either Class I or Class K conductors. Although the size of the tap channels 38 has been increased compared to the conventional connector, because of the cooperating nature of the bottom portions 46, the increase in size of the tap channels 38 and has been minimized. Thus, the body of the connector has sufficient material and sufficient dimensions to prevent failure of the connector during crimping and, has adequate electrical properties.

Increasing the size of the tap channels alone, without also providing the extended feature of the bottom portions, could have resulted in a connector without sufficient material or dimensions to prevent failure during crimping. In addition, the relatively small increase in the size of the width of the connector, due to the added distances $D_1$, is not large enough to prevent the connector 24 from being inserted into the dies 20. The shape of the bottom portions 46 also helped to minimize the increase in size of the overall connector, but still allow quick closure of the lateral side apertures 42.

Providing the extended feature of the bottom portions alone, without also providing an increased size of the tap channels, might not have prevented strands of a Class K conductor from exiting the tap channel lateral side apertures because compression forces would be exerted against the tap conductors in the tap channels before the lateral side apertures closed. However, the combination of the increased size tap channels and the extended bottom portions produces an additive affect. These features combine to close the lateral side apertures to the tap channels before compression forces on the tap conductors attempt to push the tap conductors out of the lateral side apertures, but nonetheless allows the connector to have sufficient material and rigidity to withstand the crimping action of the crimping tool without a failure of the connector.

The compression tool 2 crimps the top and bottom sections 26,28 onto the three conductors A, B and B at substantially a same time. Although the bottom portions 46 are deformed to close the lateral side apertures 42 at an early stage of the connector's crimping, the tips 58 of the bottom portions 46 contact the projections 52. This temporarily stops further significant compression of the bottom section 28 until more significant deformation of the top section 26 occurs. The legs 34,36 are crimped inward and downward towards the conductor A, and then the connector 24 is relatively evenly compressed onto the three conductors A, B and B. This prevents the connector 24 from piercing too deeply into the tap conductors B and potentially creating a bad crimp.

The connector 24 is particularly useful in the telecommunications industry for distribution of power by use of Class K conductors. The connector 24 can receive either a Class I or a Class K conductor in main run channel 30 and, can receive either a Class I and/or a Class K conductor in each of the respective two second conductor channels 38. The new design is easy to manufacture as an extrusion. The new design is capable of containing all the strands of highly flexible conductor in the tap locations. The new design has a greater conductor range. The connector 24 also uses less material during manufacturing. This results in a cost savings during manufacturing.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical compression connector comprising:

a first section having a first conductor receiving channel extending into a first top side of the connector; and a second section integrally formed with the first section; the second section having a second conductor receiving channel extending into a second lateral side of the connector and a third conductor receiving channel extending into a third lateral side of the connector, wherein the second section comprises bottom portions at the second and third conductor receiving channels curving upward and extending outward laterally past top portions of the second section at the second and third conductor receiving channels, and wherein the first and second sections are adapted to be compressed in a compression tool onto conductors at substantially a same time with apertures into the second and third conductor receiving channels at the second and third lateral sides being closed by the bottom portions of the second section before substantial compression of the first section onto its respective conductor.

2. An electrical compression connector as in claim 1 wherein the first section comprises a general U-shape.

3. An electrical compression connector as in claim 1 wherein the first and second sections are integrally formed as an extruded member.

4. An electrical compression connector as in claim 1 wherein the first and second conductor receiving channels extend generally parallel to each other.

5. An electrical compression connector as in claim 1 wherein a projection of the top portion projects in a general downward direction towards the bottom portion.

6. An electrical compression connector as in claim 1 wherein the bottom portion comprises a general curved finger shape.

7. An electrical compression connector as in claim 6 wherein the second section comprises a substantially flat bottom surface with an upward curved section at the bottom portion.

8. An electrical compression connector as in claim 6 wherein an outer end of the bottom portion has a general curved tip.

9. An electrical compression connector as in claim 1 wherein the two second conductor receiving channels are substantially mirror images of each other.

10. An electrical compression connector comprising:

a first section having a first conductor receiving channel extending into a top side of the connector; and an integral second section having two second conductor receiving channels extending into two opposite lateral sides of the connector, wherein the two second conductor receiving channels are each sized and shaped to receive and be operably compressed onto Class I stranded conductors between 14 AWG and 8 AWG in size and, alternatively, be operably compressed onto Class K stranded conductors between 14 AWG and 8 AWG in size, and wherein opposite bottom portions of the second section at the two conductor receiving channels extend upward and extend laterally outward past lateral sides of top portions of the second section at the second conductor receiving channels.

11. An electrical compression connector as in claim 10 wherein the first section comprises a general cross sectional U shape.

12. An electrical compression connector as in claim 10 wherein the first and second sections are integrally formed as an extruded member.

13. An electrical compression connector as in claim 10 wherein the first and the two second conductor receiving channels extend generally parallel to each other.

14. An electrical compression connector as in claim 10 wherein a projection of the top portion projects in a general downward direction towards the bottom portion.

15. An electrical compression connector as in claim 10 wherein the bottom portion comprises a general cross sectional curved finger shape.

16. An electrical compression connector as in claim 15 wherein the second section comprises a substantially flat bottom surface with an upward curved section at the bottom portions.

17. An electrical compression connector as in claim 15 wherein outer ends of the bottom portions each have a general curved tip.

18. An electrical compression connector as in claim 10 wherein the two second conductor receiving channels are substantially mirror images of each other.

19. In an extruded one-piece electrical compression connector having a general U-shaped top section forming a first conductor receiving channel and a bottom section having two second conductor receiving channels extending into respective opposite lateral sides of the bottom section, the improvement comprising:

bottom portions of the bottom section extending laterally outward past lateral sides of top portions of the bottom section at lateral sides of the bottom section proximate apertures into each of the two second conductor receiving channels, wherein the portions deform to close the lateral side apertures at a start of compression of the connector.

* * * * *